US011236530B2

(12) United States Patent
Pan

(10) Patent No.: US 11,236,530 B2
(45) Date of Patent: Feb. 1, 2022

(54) BUCKLE LOCK

(71) Applicant: Sinox Co., Ltd., New Taipei (TW)

(72) Inventor: Kuo-Kuang Pan, New Taipei (TW)

(73) Assignee: Sinox Co., Ltd., New Taipei (TW)

( * ) Notice: Subject to any disclaimer, the term of this patent is extended or adjusted under 35 U.S.C. 154(b) by 329 days.

(21) Appl. No.: 16/373,872

(22) Filed: Apr. 3, 2019

(65) Prior Publication Data

US 2019/0323270 A1 Oct. 24, 2019

(30) Foreign Application Priority Data

Apr. 19, 2018 (TW) ..... 107205148

(51) Int. Cl.
*E05B 73/00* (2006.01)
*E05B 37/02* (2006.01)

(52) U.S. Cl.
CPC ..... *E05B 73/0082* (2013.01); *E05B 37/02* (2013.01); *E05B 73/0005* (2013.01)

(58) Field of Classification Search
CPC .. E05B 73/0082; E05B 73/0005; E05B 37/02; E05B 73/00
USPC .... 70/14, 18, 19, 30, 49, 58, 233, 360, 361; 361/679.57, 679.58
See application file for complete search history.

(56) References Cited

U.S. PATENT DOCUMENTS 3,071,958 A * 1/1963 Russo ..... E05C 17/365 70/93
3,905,214 A * 9/1975 Bell ..... A63C 11/006 70/58
3,990,655 A * 11/1976 Covell ..... A63C 11/009 294/147
4,226,103 A * 10/1980 Strickland ..... B60R 25/08 70/14
5,035,126 A * 7/1991 Biba ..... E05B 67/003 70/18
5,379,618 A * 1/1995 Shieh ..... B60R 25/08 70/227
5,517,837 A * 5/1996 Wang ..... E05B 67/36 70/226
5,530,427 A * 6/1996 Shieh ..... B60R 25/1001 188/69
6,308,540 B1 * 10/2001 Lee ..... E05B 73/0005 42/70.07
6,474,116 B1 * 11/2002 Lai ..... E05B 37/025 70/25
6,742,366 B1 * 6/2004 Lai ..... E05B 37/025 70/30
7,281,400 B2 * 10/2007 Muerza ..... B62H 5/18 70/226
7,299,668 B1 * 11/2007 Lu ..... E05B 73/0082 70/14

(Continued)

*Primary Examiner* — Lloyd A Gall
(74) *Attorney, Agent, or Firm* — Schmeiser, Olsen & Watts LLP

(57) ABSTRACT

A buckle lock is applied to lock a device having a fastening portion and comprises a body, the body includes a locking mechanism and includes a fixing groove configured to retain with the fastening portion of the device. The body further includes a press rod configured to move toward a unlocking position of the fixing groove so as to allow the fastening portion to move out of the fixing groove, and the press rod is also configured to move toward a locking position of the fixing groove so as to stop a removal of the fastening portion from the fixing groove.

14 Claims, 8 Drawing Sheets

(56) References Cited

U.S. PATENT DOCUMENTS 8,037,722 B2 * 10/2011 Ng ..... B62H 5/18 70/33
8,646,297 B2 * 2/2014 Foti ..... B62H 5/18 70/233
9,435,144 B2 * 9/2016 Bullwinkel ..... E05B 21/06
2003/0140662 A1 * 7/2003 Hsu ..... E05B 73/0082 70/18
2004/0103699 A1 * 6/2004 Ho ..... B60D 1/62 70/14
2005/0204786 A1 * 9/2005 Meyer ..... E05B 73/0082 70/58
2006/0225470 A1 * 10/2006 Avganim ..... E05B 73/0082 70/58
2007/0022792 A1 * 2/2007 Xavier ..... B62H 5/141 70/33
2007/0157680 A1 * 7/2007 DeMartinis ..... E05B 73/0082 70/57
2007/0245778 A1 * 10/2007 Lu ..... E05B 73/0082 70/58
2012/0204608 A1 * 8/2012 Sayegh ..... E05B 73/0017 70/19
2014/0060126 A1 * 3/2014 Stevens ..... E05B 67/36 70/18
2015/0152670 A1 * 6/2015 Kopco ..... A47F 5/0861 70/14
2015/0267439 A1 * 9/2015 Thoonsen ..... E05B 73/0017 340/572.1
2016/0090755 A1 * 3/2016 Lee ..... E05B 73/0082 248/553
2016/0102483 A1 * 4/2016 Luo ..... E05B 73/0035 70/57.1
2017/0051537 A1 * 2/2017 Wang ..... E05B 67/003

* cited by examiner

BUCKLE LOCK

CROSS-REFERENCE OF RELATED APPLICATIONS

This application claims priority to Taiwan Application No. 107205148, filed Apr. 19, 2018 which is incorporated herein by reference in its entirety.

FIELD OF THE INVENTION

The present invention relates to a buckle lock which is applied to lock a device having a support stand, a hanger hole, or a support stand having a reinforcement extension securely.

BACKGROUND OF THE INVENTION

Portable electronic device (such as a table and a smartphone) is expensive, so it is important to avoid the portable electronic device being stolen. However, the many electronic devices cannot be locked securely.

The present invention has arisen to mitigate and/or obviate the afore-described disadvantages.

SUMMARY OF THE INVENTION

The primary aspect of the present invention is to provide a buckle lock which is applied to lock a device having a support stand, a hanger hole, or a support stand having a reinforcement extension securely.

To obtain above-mentioned aspect, a buckle lock provided by the present invention contains: a body, the body includes a locking mechanism, a fixing groove configured to retain with the fastening portion of the device, and a press rod configured to move toward a unlocking position of the fixing groove so as to allow the fastening portion to move out of the fixing groove, and the press rod is also configured to move toward a locking position of the fixing groove so as to stop a removal of the fastening portion from the fixing groove.

Preferably, the press rod is arranged on the locking mechanism.

Preferably, the locking mechanism is a key lock.

Preferably, the locking mechanism is a combination lock.

Preferably, the fixing groove has a flexible pad arranged thereon.

Preferably, the locking mechanism pushes the press rod toward the unlocking position of the fixing groove normally, and when the locking mechanism releases the press rod, the press rod moves back to the unlocking position of the fixing groove from the locking position of the fixing groove automatically.

Preferably, when the press rod is located at the locking position of the fixing groove, it closes an opening of the locking groove completely.

Preferably, when the press rod is located at the locking position of the fixing groove, it stops a removal of the fastening portion from the fixing groove.

Preferably, the body is in connection with a first end of a steel cable, and a second end of the steel cable is coupled with a connection object.

Preferably, the fastening portion is any one of a support stand, a hanger hole, and a support stand having a reinforcement extension.

DETAILED DESCRIPTION OF THE PREFERRED EMBODIMENTS

Figure 1:
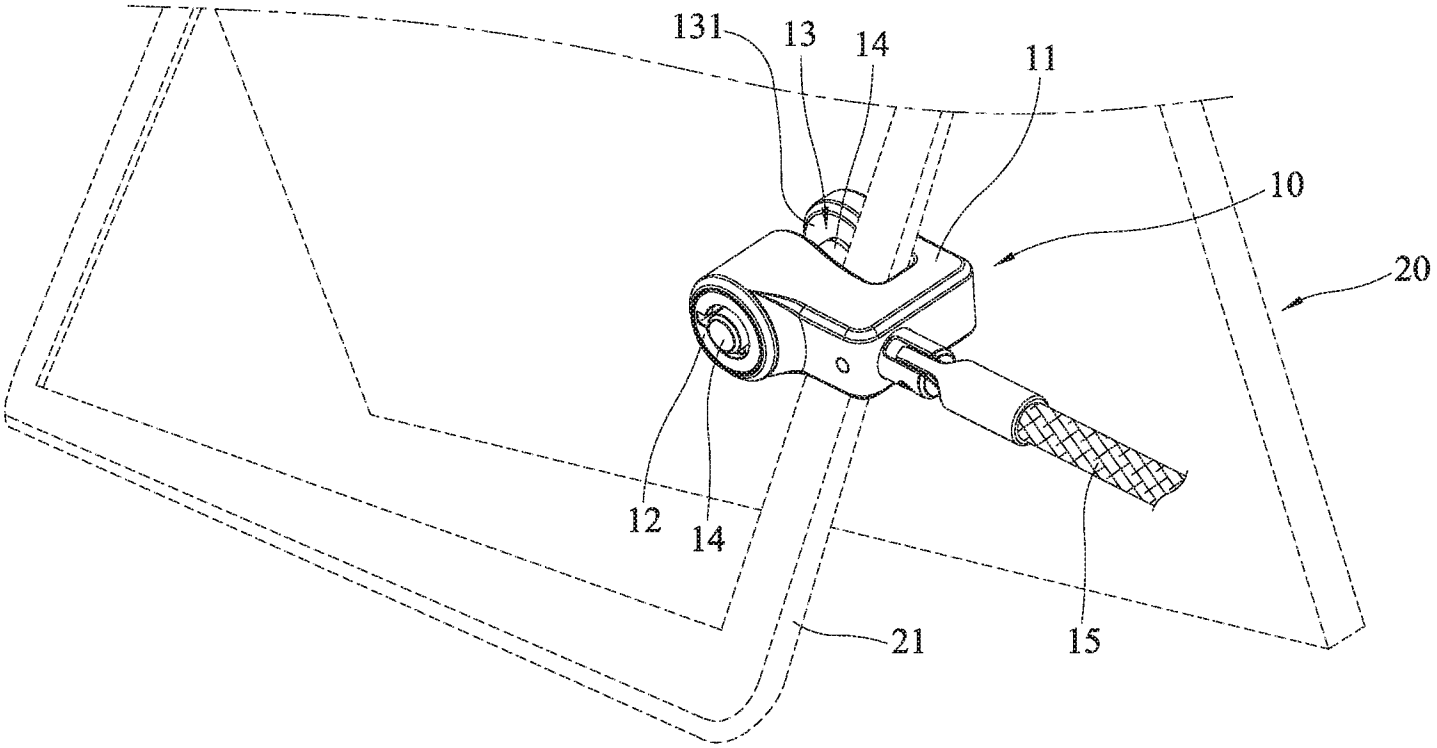
FIG. 1 is a perspective view showing the application of a buckle lock according to a first embodiment of the present invention.
Figure 2:
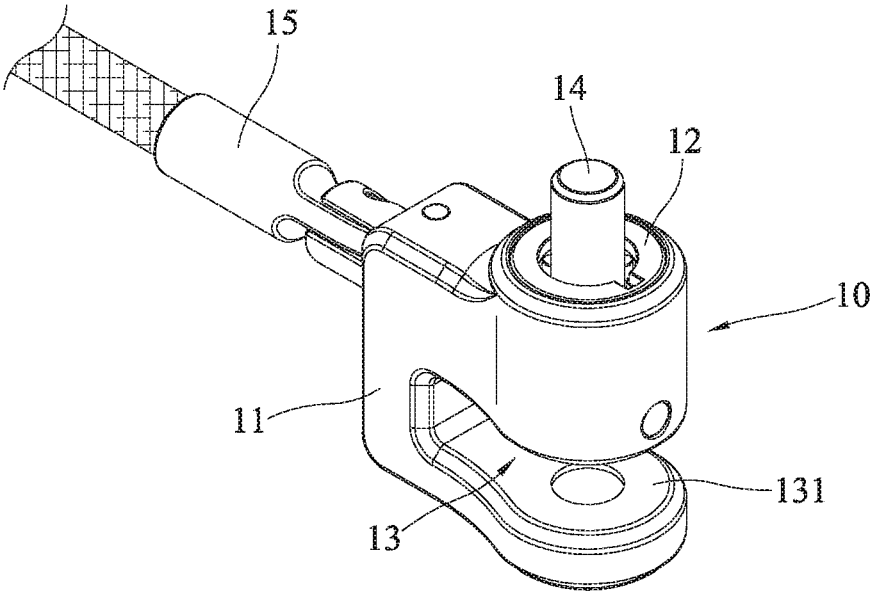
FIG. 2 is a perspective view showing the operation of the buckle lock according to the first embodiment of the present invention.
Figure 3:
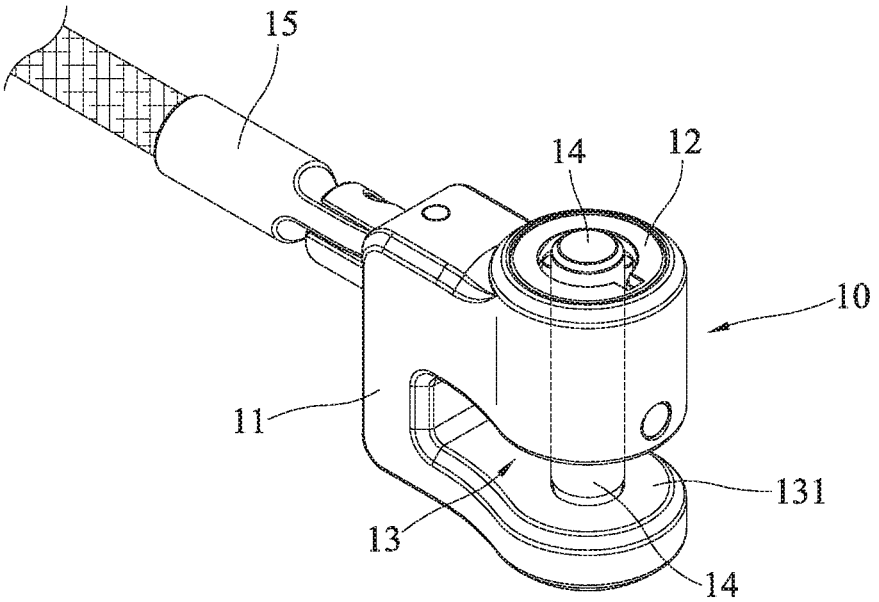
FIG. 3 is another perspective view showing the operation of the buckle lock according to the first embodiment of the present invention.

With reference to FIGS. 1-3, a buckle lock 10 according to a first embodiment of the present invention is applied to lock a device 20 (denoted by a dotted line) having a fastening portion 21 (such as a support stand or a hanger hole). The device 20 can be any one of electronic devices such as notebook computer, a tablet, and etc. In this embodiment, the device 20 is the tablet having the support stand.

The buckle lock 10 comprises a body 11 which includes a locking mechanism 12 and includes a fixing groove 13 configured to retain with the fastening portion 21 of the device 20, wherein the fastening portion 21 is the support stand or the hanger hole which is connected on the device 20.

The body 11 further includes a press rod 14 which is configured to move toward a unlocking position of the fixing groove 13 (as shown in FIG. 2) so as to allow the fastening portion 21 to move out of the fixing groove 13, and the press rod 14 is also configured to move toward a locking position of the fixing groove 13 (as illustrated in FIG. 3) so as to stop a removal of the fastening portion 21 from the fixing groove 13, wherein when the press rod 14 is moved toward the locking position of the fixing groove 13, it is locked by the locking mechanism 12. The fixing groove 13 has a flexible pad 131 arranged thereon so as to avoid an abrasion between the fixing groove 13 and the fastening portion 21.

The locking mechanism 12 is a key lock or a combination lock. Furthermore, the press rod 14 is arranged on the locking mechanism 12 or is an independent component apart from the locking mechanism 12.

The locking mechanism 12 has a resilient element (not shown) configured to push the press rod 14 toward the unlocking position of the fixing groove 13 normally, and when the locking mechanism 12 releases the press rod 14, the press rod 14 moves back to the unlocking position of the fixing groove 13 from the locking position of the fixing groove 13 automatically.

The body 11 is in connection with a first end of a steel cable 15 so that when the buckle lock 10 is locked on the device 20, and a second end of the steel cable 15 is coupled with a connection object (such as one of the table's legs or a wall column), thus locking the device 20 securely.

Figure 4:
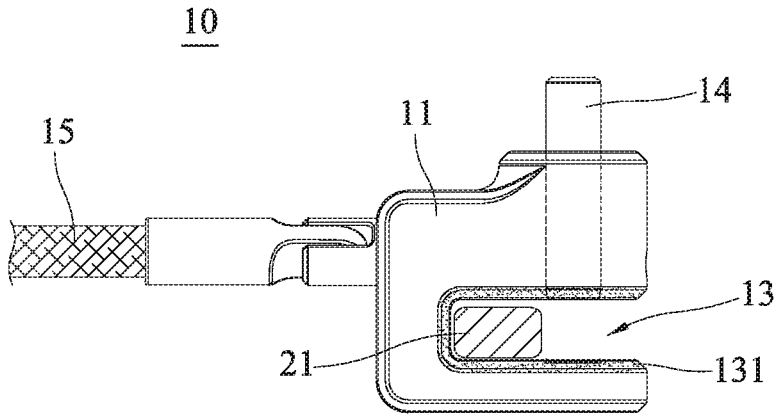
FIG. 4 is a side plan view showing the operation of the buckle lock according to the first embodiment of the present invention.
Figure 5:
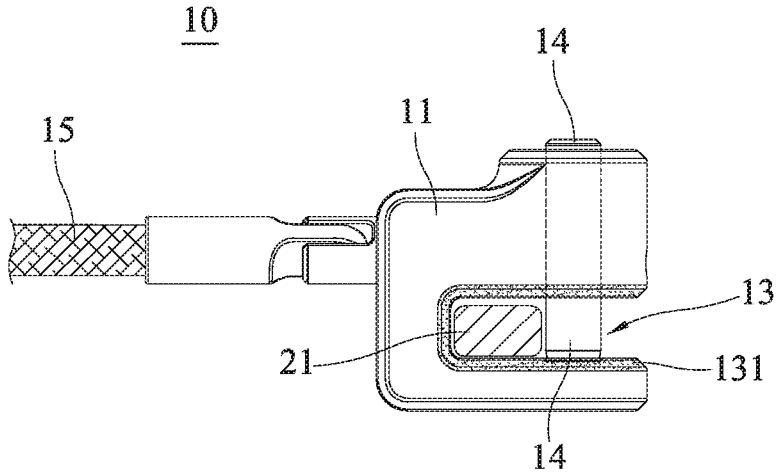
FIG. 5 is another plan view showing the operation of the buckle lock according to the first embodiment of the present invention.

Referring to FIG. 4, when the press rod 14 is located on the unlocking position, the body 11 is fastened on the fastening portion 21 by ways of the fixing groove 13 so that the fastening portion 21 is retained into the fixing groove 13. As shown in FIG. 5, the press rod 14 is pressed by a user's finger to move toward the locking position and is locked by the locking mechanism 12 (i.e., the key lock or the combination lock) so that the buckle lock 10 is locked onto the device 20.

The device 20 is unlocked by the locking mechanism 12 (i.e., the key lock or the combination lock) so that the press rod 14 moves back to the unlocking position of the fixing groove 13 automatically, and the body 11 is removed from the device 20.

Figure 6:
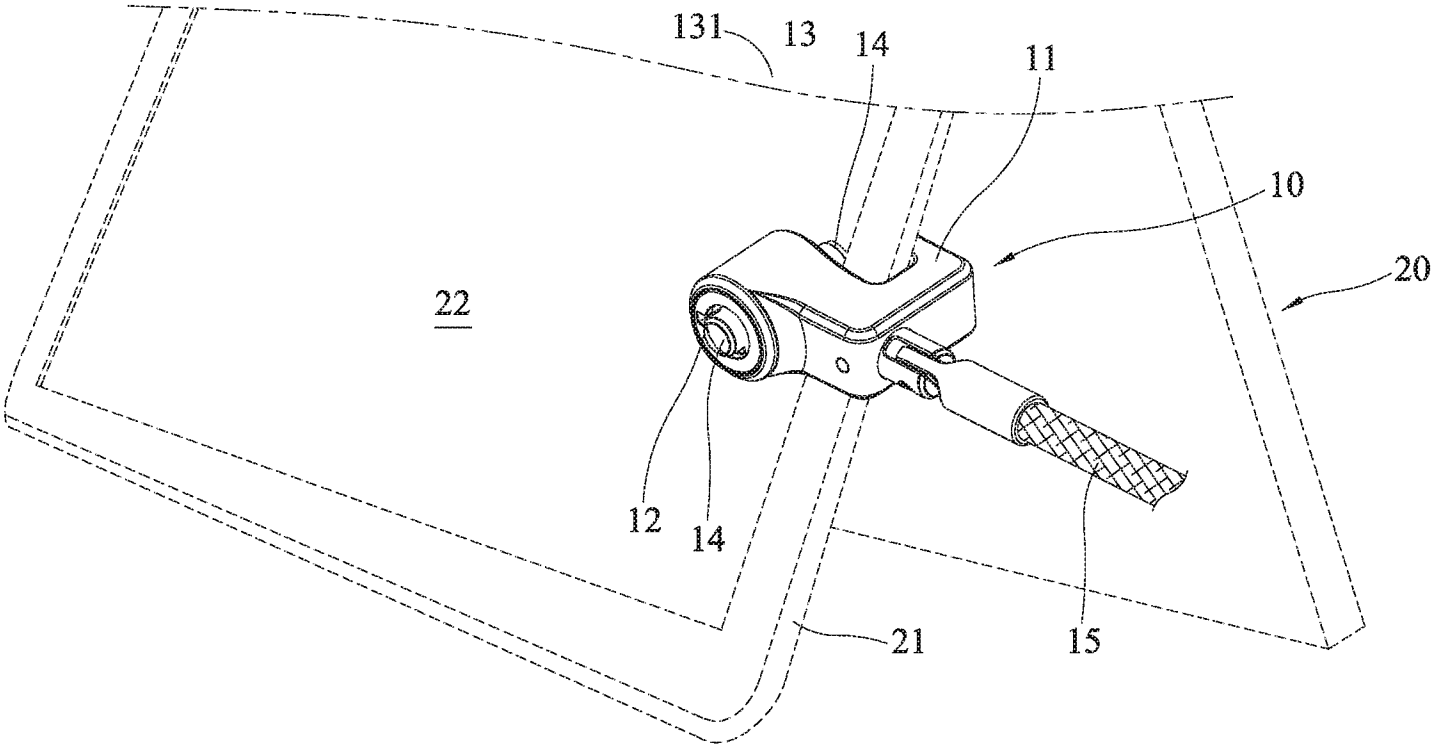
FIG. 6 is another perspective view showing the application of the buckle lock according to the first embodiment of the present invention.
Figure 7:
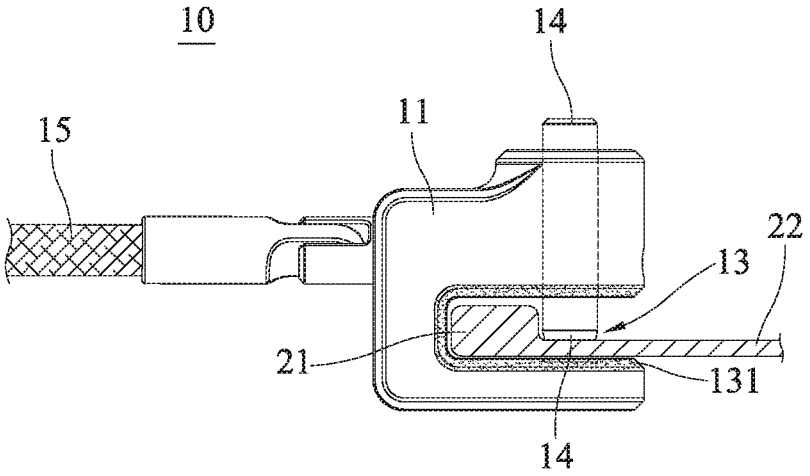
FIG. 7 is a side plan view showing the application of the buckle lock according to the first embodiment of the present invention.

When the press rod 14 is located at the locking position, it closes an opening of the locking groove 13 completely. With reference to FIGS. 6 and 7, when the fastening portion 21 of the device 20 is the support stand having a reinforcement extension 22, the press rod 14 is located on another locking position of the fixing groove 13 so as to engage with the reinforcement extension 22. In other words, the press rod 14 stops a removal of the fastening portion 21 from the fixing groove 13 and does not close the opening of the fixing groove 13 completely.

Figure 8:
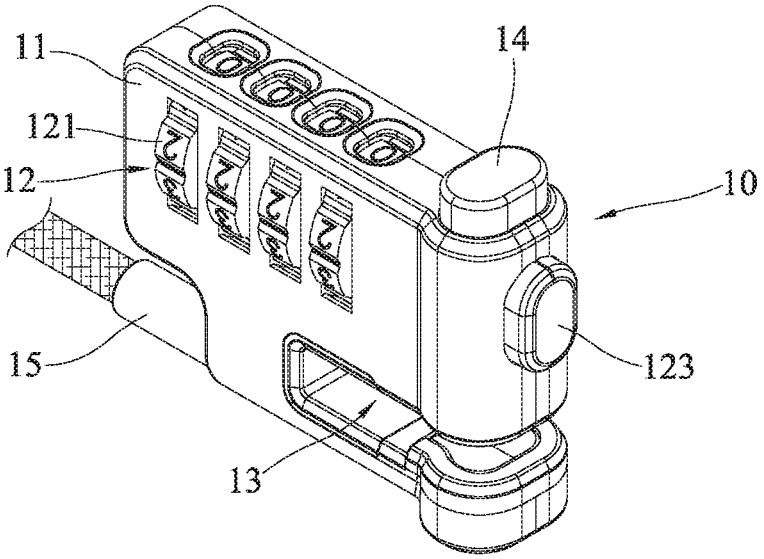
FIG. 8 is a perspective view showing the operation of a buckle lock according to a second embodiment of the present invention.
Figure 9:
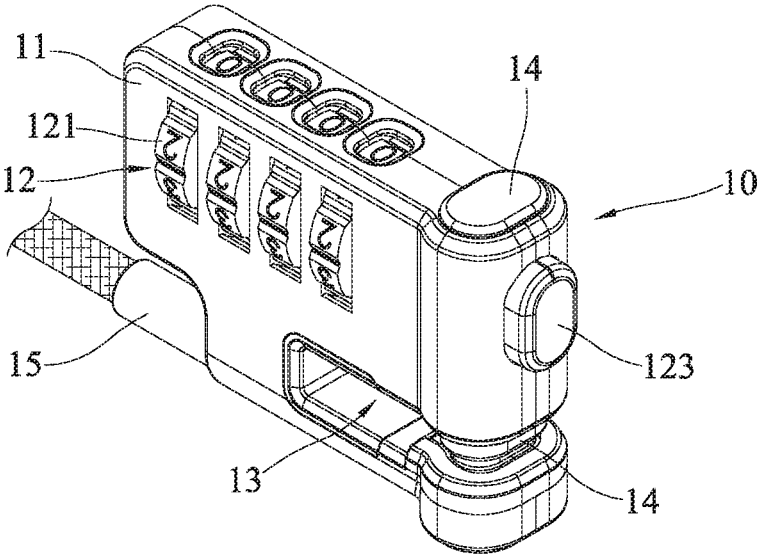
FIG. 9 is another perspective view showing the operation of the buckle lock according to the second embodiment of the present invention.

Referring to FIGS. 8 and 9, in a second embodiment, the buckle lock 10 comprises a body 11 which includes a locking mechanism 12 and includes a fixing groove 13 configured to fasten with the fastening portion 21 of the device 20.

The body 11 further includes a press rod 14 which is configured to move toward an unlocking position of the fixing groove 13 (as shown in FIG. 8) so as to allow the fastening portion 21 to move out of the fixing groove 13, and the press rod 14 is also configured to move toward a locking position of the fixing groove 13 (as illustrated in FIG. 9) so as to stop a removal of the fastening portion 21 from the fixing groove 13.

The locking mechanism 12 has a resilient element 16 configured to push the press rod 14 toward the unlocking position of the fixing groove 13 normally, and when the locking mechanism 12 releases the press rod 14, the press rod 14 moves back to the unlocking position of the fixing groove 13 from the locking position of the fixing groove 13 automatically.

The body 11 is in connection with a first end of a steel cable 15 so that when the buckle lock 10 is locked onto the device 20, and a second end of the steel cable 15 is coupled with a connection object (such as one of the table's legs or a wall column), thus locking the device 20 securely.

Figure 10:
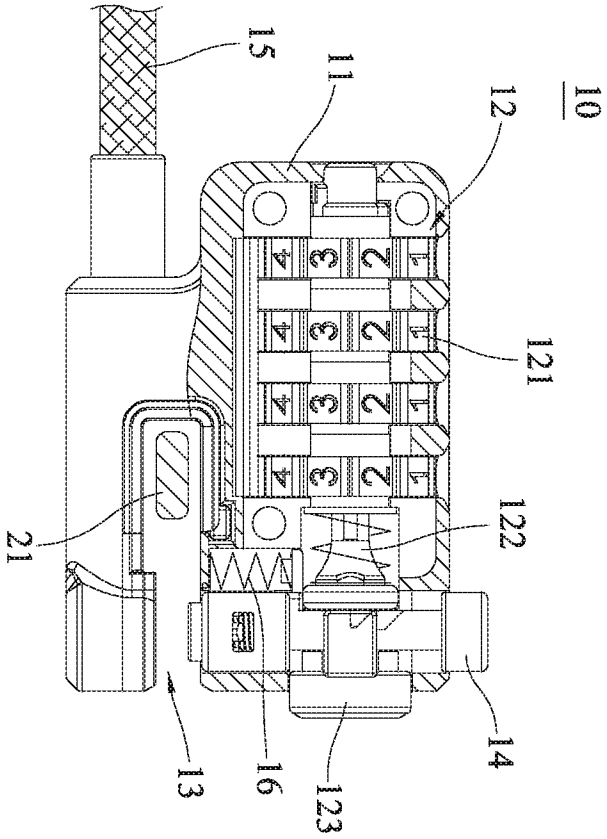
FIG. 10 is a cross-sectional view showing the operation of the buckle lock according to the second embodiment of the present invention.
Figure 11:
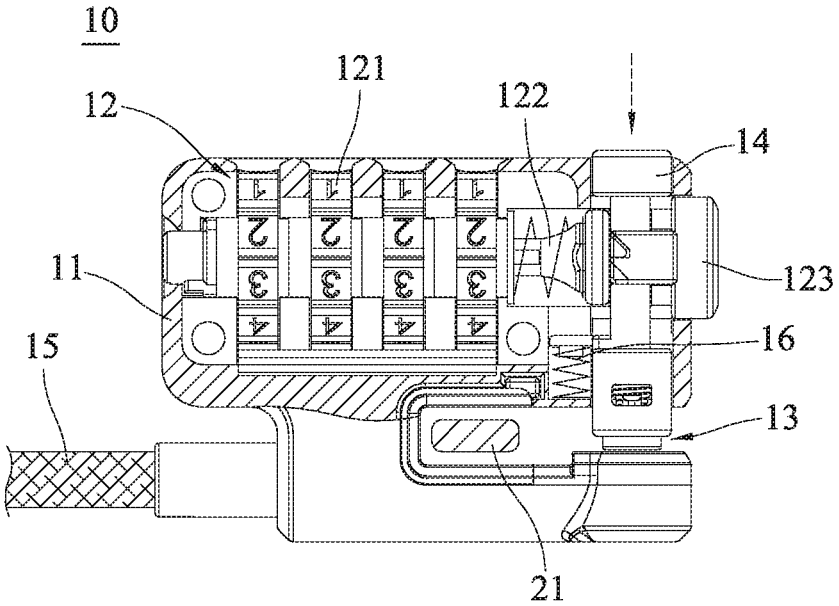
FIG. 11 is another cross-sectional view showing the operation of the buckle lock according to the second embodiment of the present invention.

In this embodiment, the locking mechanism 12 is a combination lock. As shown in FIG. 10, the locking mechanism 12 has multiple code lock rings 121, a lock tongue 122, and a unlock button 123. Referring to FIG. 10, when the press rod 14 is located on the unlocking position, the body 11 is fastened on the fastening portion 21 by ways of the fixing groove 13 so that the fastening portion 21 is retained into the fixing groove 13. As shown in FIG. 11, the press rod 14 is pressed by a user's finger to move toward the locking position, and the multiple code lock rings 121 are rotated to locking codes respectively so that the press rod 14 is locked by the locking mechanism 12, and the buckle lock 10 is locked onto the device 20. In the meantime, the lock tongue 122 is fixed so that the release button 123 does not push the lock tongue 122 to move.

Figure 12:
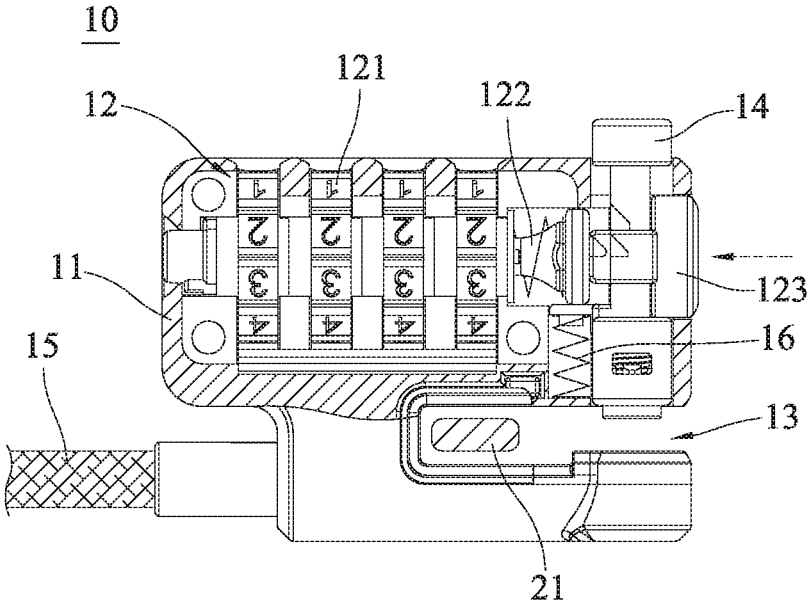
FIG. 12 is also another cross-sectional view showing the operation of the buckle lock according to the second embodiment of the present invention.

As shown in FIG. 12, the multiple code lock rings 121 are rotated to unlocking codes respectively, and the release button 123 is pressed to push the lock tongue 122 to remove from the press rod 14 so that the press rod 14 moves back to the unlocking position automatically.

Thereby, the buckle lock 10 is applied to lock a device 20 having the support stand or the hanger hole securely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A buckle lock being applied to lock a device having a fastening portion and comprising:

a body including a fixing groove; and the body further including a press rod configured to move between an unlocking position so as to allow the fastening portion to move out of the fixing groove, and a locking position so as to stop a removal of the fastening portion from the fixing groove;

a lock tongue engaging the press rod when the press rod is at the locking position so as to stop movement of the press rod from the locking position to the unlocking position;

a locking mechanism configured to lock the lock tongue so as to stop removal of the lock tongue from the press rod and to unlock the lock tongue so as to allow the lock tongue to disengage the press rod; and a release button configured to be pushed by a user so as to disengage the lock tongue from the press rod when the locking mechanism unlocks the lock tongue.

2. The buckle lock as claimed in claim 1, wherein the locking mechanism is a combination lock.

3. The buckle lock as claimed in claim 1, wherein the fixing groove has a flexible pad arranged thereon.

4. The buckle lock as claimed in claim 1, wherein when the press rod is located at the locking position of the fixing groove, it closes an opening of the fixing groove completely.

5. The buckle lock as claimed in claim 1, wherein the body is in connection with a first end of a steel cable, and a second end of the steel cable is coupled with a connection object.

6. The buckle lock as claimed in claim 1, wherein the press rod is between the lock tongue and the release button.

7. The buckle lock as claimed in claim 1, wherein the lock tongue is between the locking mechanism and the press rod.

8. The buckle lock as claimed in claim 1, wherein the lock tongue is between the locking mechanism and the release button.

9. The buckle lock as claimed in claim 1, wherein the release button extends perpendicular to the press rod.

10. The buckle lock as claimed in claim 1, wherein the release button is collinear with the lock tongue.

11. The buckle lock as claimed in claim 1, wherein the press rod is formed with a recess, the lock tongue has a protrusion, and when the press rod is at the locking position, the lock tongue is configured to move between an engaging position, where the protrusion engages the recess, and a disengaging position, where protrusion disengages the recess.

12. The buckle lock as claimed in claim 11, wherein locking mechanism is configured to lock the lock tongue at the engaging position.

13. The buckle lock as claimed in claim 11, wherein the release button is configured to be pushed by a user so as to move the lock tongue from the engaging position to the disengaging position.

14. The buckle lock as claimed in claim 1, wherein the body including a first body portion and a second body portion, the press rod is coupled to the first body portion, when the press rod is at the locking position, the fastening portion is engaged between the press rod and the second body portion, and when the press rod is at unlocking position, the fastening portion is disengaged by the press rod and the second body portion.

* * * * *